US005088612A

United States Patent [19]

Storar et al.

[11] Patent Number: 5,088,612

[45] Date of Patent: Feb. 18, 1992

[54] VIAL CAP

[75] Inventors: James R. Storar, Buena; David A. Manera, Vineland, both of N.J.

[73] Assignee: Comar, Inc., Buena, N.J.

[21] Appl. No.: 712,484

[22] Filed: Jun. 10, 1991

[51] Int. Cl.[5] ..... B65D 41/20

[52] U.S. Cl. ..... 215/247; 215/249; 215/235; 215/237

[58] Field of Search ..... 215/247, 341, 235, 237, 215/249

[56] References Cited

U.S. PATENT DOCUMENTS

| | | | |
|---|---|---|---|
| 4,109,815 | 8/1978 | Collins, III | 215/341 X |
| 4,220,248 | 9/1980 | Wilson et al. | 215/235 |
| 4,795,043 | 1/1989 | Odet et al. | 215/235 |
| 4,917,253 | 4/1990 | Dutt | 215/235 |
| 4,974,735 | 12/1990 | Newell et al. | 215/235 X |
| 4,993,606 | 2/1991 | Bolen, Jr. et al. | 215/235 X |

FOREIGN PATENT DOCUMENTS

| | | | |
|---|---|---|---|
| 2100237 | 12/1982 | United Kingdom | 215/247 |

*Primary Examiner*—Stephen Marcus
*Assistant Examiner*—Paul A. Schwarz
*Attorney, Agent, or Firm*—Brady, O'Boyle & Gates

[57] ABSTRACT

A vial cap of plastic having a skirt portion press fit onto the neck of a vial. A transversely extending wall having a central opening is integral with the upper end portion of the skirt, and a sealing disc is positioned between the open end of the vial and the transverse wall. A plastic lid having a plastic hinge integrally connected between the lid and the skirt is provided for closing the central opening of the cap during storage. By the construction and arrangement of the plastic vial cap, the fear of aluminum toxicity is overcome and the lid prevents the accumulation of dust and other debris on the sealing disc while the vial is in storage.

7 Claims, 2 Drawing Sheets

VIAL CAP

BACKGROUND OF THE INVENTION

Conventional medical vials containing medicaments and serums include a sealing disc extending across the open top of the vial and held thereon by an aluminum collar crimped to the neck of the vial, whereby a hypodermic needle may be inserted through the sealing disc for removal of the contents therefrom.

While these conventional vials have been satisfactory for their intended purpose, the possibility of toxicity caused by the aluminum, and the exposure of the sealing disc to atmospheric particulates, such as dust, during the storage of the vial required an improvement to the conventional vial to enhance its sterility.

SUMMARY OF THE INVENTION

After considerable research and experimentation, the vial cap of the present invention has been devised which comprises, essentially, a plastic cap having a skirt portion press fit onto the neck portion of a vial. The cap has a transversely extending wall portion integral with the upper end portion of the skirt, and a sealing disc is positioned between the open end of the vial and the transversely extending wall portion. A central opening is provided in the transversely extending wall of the cap, whereby a hypodermic needle may be inserted through the sealing disc to remove the contents from the vial.

A plastic lid having a plastic hinge integrally connected between the lid and the upper end portion of the cap skirt is provided for closing the central opening of the cap during storage.

The lid and transversely extending cap wall have cooperating finger portions to hold the lid in the open position while the needle is being inserted through the sealing disc, and the cap lid and transversely extending cap wall are also provided with a cooperating recess and tongue, respectively, for holding the lid closed during the storage of the vial.

By the construction and arrangement of the plastic vial cap of the present invention, the fear of aluminum toxicity is overcome and the lid prevents atmospheric dust and other debris from collecting on the sealing disc while the vial is in storage.

DESCRIPTION OF THE PREFERRED EMBODIMENT

Figure 2:
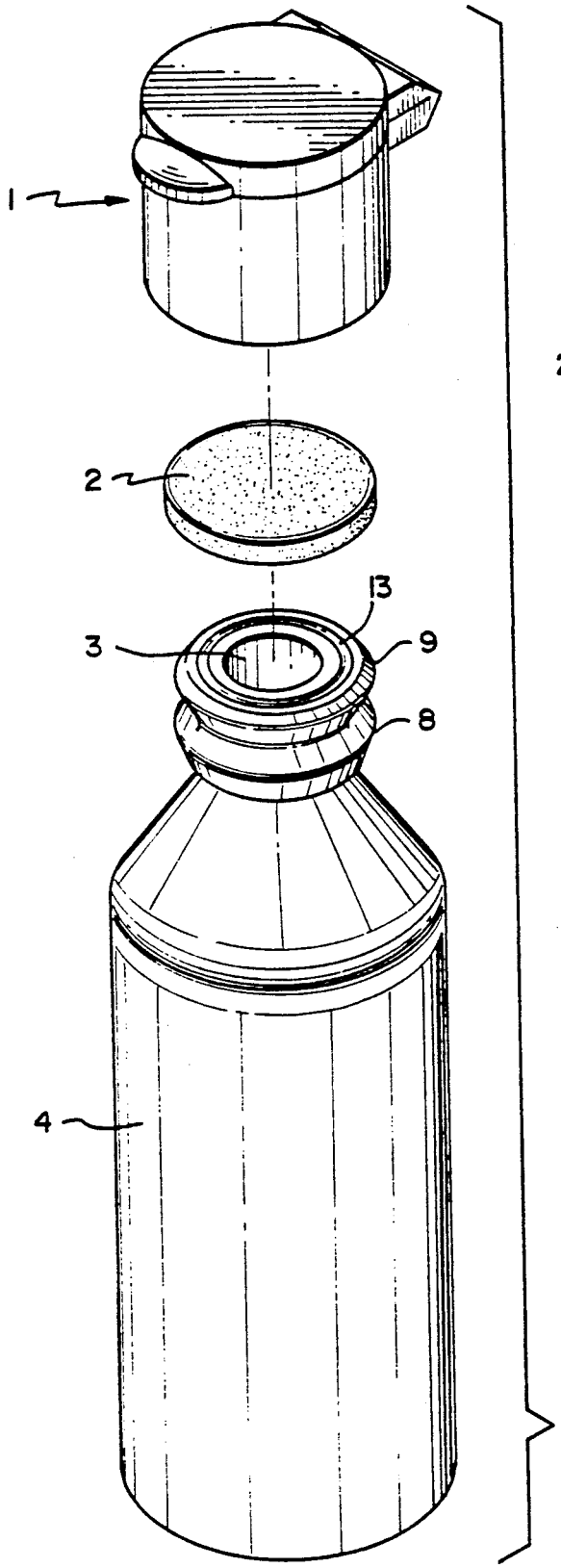
FIG. 2 is an assembled perspective view of the vial, sealing disc and cap with the cap lid in the open position.
Figure 1:
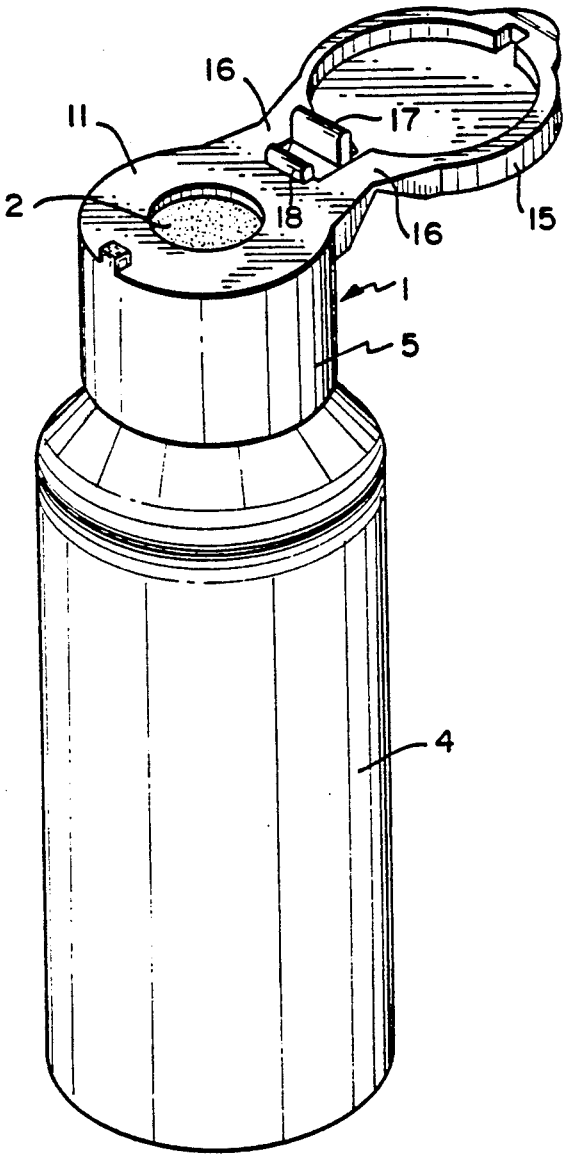
FIG. 1 is an exploded perspective view of a vial, a sealing disc, and the cap of the present invention.

Referring to the drawings and more particularly to FIGS. 1 and 2, the plastic cap 1 of the present invention is constructed and arranged to secure a rubber sealing disc 2 to the open end 3 of a glass vial 4 adapted to contain a medicament or serum removable therefrom by a hypodermic needle, not shown, insertable through the sealing disc 2.

The details of the construction of the cap 1 are illustrated in FIGS. 2 to 5, wherein it will be seen that the cap includes a skirt portion 5 having a pair of axially spaced annular ribs 6 and 7 formed on the inner wall surface thereof which cooperate with a pair of axially spaced annular beads 8 and 9 integral with the outer wall surface of the vial neck 10, whereby the cap 1 is press fit onto the neck 10 of the glass vial 4.

A transversely extending wall 11 is integrally formed on the upper end portion of the skirt and is provided with a central opening 12 through which a hypodermic needle extends when piercing the sealing disc 2.

To further seal the contents within the vial 4, the upper end portion of the vial neck 10 around the open end 3 thereof is formed with an annular bead 13 which is pressed into the lower surface of the sealing disc 2, and a depending annular knife edge 14 is formed on the lower surface of the transversely extending wall 11 which is pressed into the upper surface of the sealing disc 2.

In order to prevent atmospheric contaminants from accumulating on the sealing disc 2, a plastic lid 15 is provided having plastic hinge portions 16 integrally connected between the lid 15 and the upper end portion of the cap skirt 5.

Figure 3:
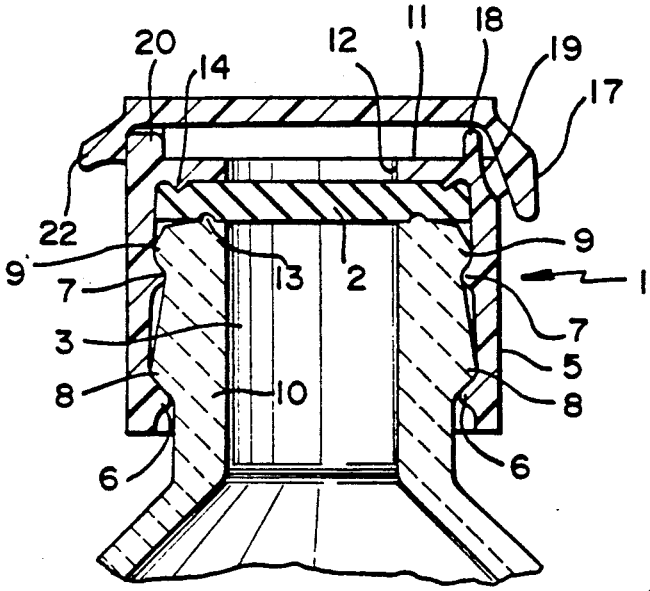
FIG. 3 is a fragmentary, side elevational view, in section, showing the cap and sealing disc mounted on the top of the vial with the cap lid in the closed position.
Figure 4:
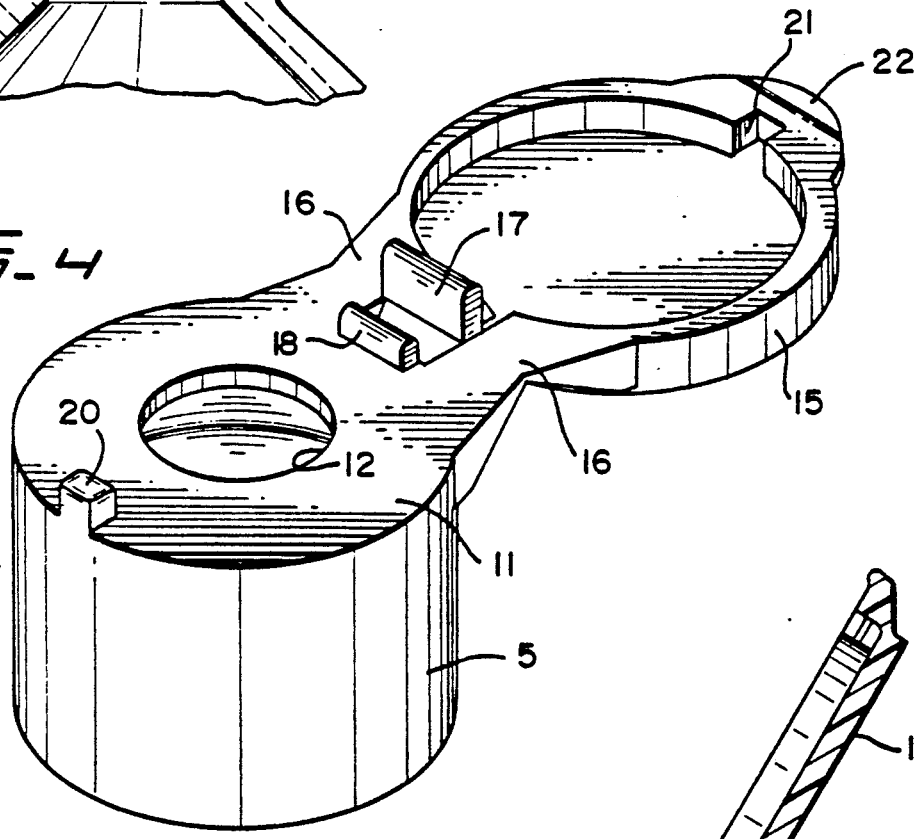
FIG. 4 is a perspective view of the cap of the present invention with the lid in the fully open position.
Figure 5:
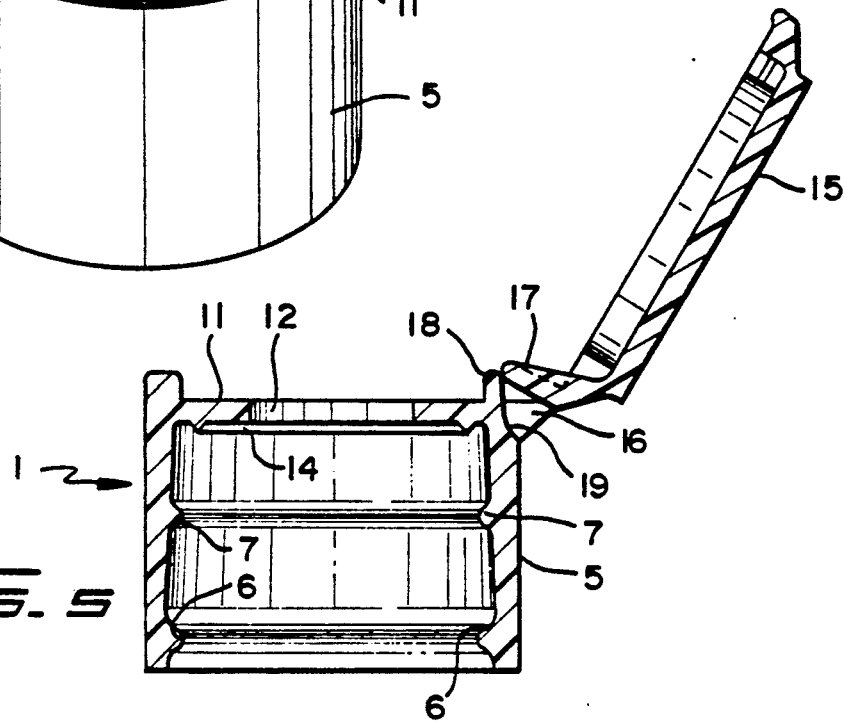
FIG. 5 is a sectional, side elevational view of the cap showing the lid in the partially open position.

In order to prevent the lid 15 from accidentally pivoting to the closed position after it has been manually moved to the open position, a finger member 17 is integrally formed on the lid 15 in between the hinge portions 16, and another finger member 18 is integral with the upper surface of the transversely extending wall 11. The end portions of the finger members 17 and 18 become frictionally engaged, as shown in FIG. 5, to prevent the lid 15 from freely pivoting to the closed position. One side of the finger 18 is provided with a sloped surface 19 which the end portion of the finger 17 slides downwardly upon when the lid is manually pushed to the closed position as shown in FIG. 3.

To hold the lid 15 in the closed position, the upper surface of the transversely extending wall 11 is provided with an upwardly extending tongue member 20 which is frictionally received with a correspondingly-shaped recess 21 formed in the peripheral portion of the lid 15.

To facilitate the opening of the lid 15, a radially outwardly extending thumb tab 22 is formed integrally with the peripheral portion of the lid 15.

From the above description, it will be readily apparent to those skilled in the art that the plastic cap of the present invention can be readily molded with the integral hinge and lid which not only prevents atmospheric dust from accumulating on the sealing disc while the vial is in storage, but also overcomes the fear of aluminum toxicity provided by conventional medicament vials.

It is to be understood that the form of the invention herewith shown and described is to be taken as a preferred example of the same, and that various changes in the shape, size and arrangement of parts may be resorted to, without departing from the spirit of the invention or scope of the subjoined claims.

We claim:

1. In combination, a cap and overseal on a vial having a neck portion surrounding an open end portion thereof, a pair of axially spaced radially outwardly extending annular beads integral with the outer wall surface of said vial neck, said cap having a skirt portion, a pair of axially spaced radially inwardly extending annular ribs integral with the inner wall of said skirt portion, said skirt portion being press fit onto the neck portion of the vial wherein each annular rib extends inwardly against the lower surface of a respective bead, a transversely extending wall portion integral with the upper end portion of the skirt, a self-sealing disc mounted on the upper edge portion of the neck between the open end of the vial and the transversely extending wall portion, a central opening formed in the transversely extending wall of the cap, whereby a hypodermic needle may be inserted through the sealing disc to remove contents from the vial, a lid, and a hinge connected between the lid and the upper end portion of the cap skirt, whereby the lid can be pivoted from an open position to a closed position over the central opening in the transverse wall to thereby cover the sealing disc to prevent the accumulation of atmospheric debris thereon during storage.

2. The combination according to claim 1, wherein an annular bead is formed on the upper end portion of the vial neck around the open end thereof, said annular bead being pressed into the lower surface of the sealing disc.

3. The combination according to claim 2, wherein a depending annular knife edge is formed on the lower surface of the transversely extending wall, said annular knife edge being pressed into the upper surface of the sealing disc.

4. The combination according to claim 1, wherein the skirt, hinge and lid are of molded plastic, the hinge being integrally connected between the lid and the upper end portion of the cap skirt.

5. The combination according to claim 4, wherein a finger member is integrally formed on the lid adjacent the hinge, and another finger member is integral with the upper surface of the transversely extending wall, the end portions of said fingers being frictionally engageable to prevent the lid from freely pivoting to the closed position.

6. The combination according to claim 5, wherein an upwardly extending tongue member is formed on the transversely extending wall, and a correspondingly-shaped recess is formed on the lid for frictionally receiving the tongue member therein for holding the lid in the closed position.

7. The combination according to claim 6, wherein a radially outwardly extending tab is formed integrally with the peripheral portion of the lid to facilitate manually opening the lid.

* * * * *